United States Patent [19]

Branker

[11] 4,397,382

[45] Aug. 9, 1983

[54] COIN OPERATED METER

[76] Inventor: H. Earle Branker, 1220 Blairmill Rd., Silver Spring, Md. 20901

[21] Appl. No.: 291,819

[22] Filed: Aug. 10, 1981

[51] Int. Cl.[3] ..... G07F 17/24

[52] U.S. Cl. ..... 194/61; 194/1 D

[58] Field of Search ..... 194/DIG. 22, 1 E, 9 T, 194/1, 2, 72, 74, 13, 1 F, 1 C, 1 D, 61

[56] References Cited

U.S. PATENT DOCUMENTS

| | | | |
|---|---|---|---|
| 2,070,445 | 2/1937 | Miller et al. | 194/72 |
| 2,171,345 | 8/1939 | Rockola et al. | 194/61 |
| 2,198,779 | 4/1940 | Long | 194/1 |
| 2,199,330 | 4/1940 | Bullock et al. | 194/74 |
| 2,603,288 | 7/1952 | Sollenberger | 161/15 |
| 2,777,555 | 1/1957 | Banning | 194/13 |
| 3,208,573 | 9/1965 | Carroll et al. | 194/2 |
| 3,805,936 | 4/1974 | Jensen | 194/1 |
| 3,828,903 | 8/1974 | Levasseur | 194/1 |
| 3,828,907 | 8/1974 | Bock | 194/72 |

*Primary Examiner*—Stanley H. Tollberg

*Attorney, Agent, or Firm*—Roylance, Abrams, Berdo & Farley

[57] ABSTRACT

A coin operated meter has a housing with a coin box, coin return and clock mechanism located within the housing. The clock mechanism is wound by the successive insertion of coins within the meter. An escrow support mechanism within the housing selectively retains releaseably at least one escrow coin in the housing, directs the escrow coin to the coin box or returns the escrow coin to a parker. A programming mechanism actuates the escrow support mechanism in response to movement of the clock mechanism to selectively and automatically pass the escrow coin to the coin box. An escrow release mechanism permits return of the escrow coin when the parker returns to the meter prior to the expiration of the prepaid time. The escrow release mechanism is coupled to an escrow lock to prevent unauthorized release of the escrow coin. In this manner, the retention of the escrow coin automatically permits the meter to charge a higher parking rate fee for overtime parking without monitoring by the local authorities.

11 Claims, 7 Drawing Figures

COIN OPERATED METER

BACKGROUND OF THE INVENTION

1. Field of the Invention

This invention relates to a coin operated meter of the type employed as a parking meter. More particularly, the present invention relates to a coin operated meter which collects fees at a higher or penalty rate during a premium overtime period than during a prepaid time period and which holds coins in escrow to pay the higher overtime rate, returning the escrow coins upon actuation of the meter prior to the expiration of the prepaid time period and capturing the escrow coins automatically after expiration of the prepaid time period.

2. Description of the Prior Art

Overtime parking has created problems for both the local authorities responsible for monitoring parking and for the public using parking facilities. Parking meters which only collect fees at a single, prepaid rate do not discourage adequately use of the full time period permitted by the meter. Detection of overtime parking can only be accomplished by monitoring the meters and issuing parking tickets to the violators, which parking tickets involve a large administrative burden on the local authority and are a constant annoyance to the public. Additionally, parking tickets do not insure payment by the violator who is not subject to the jurisdiction of the local authorities and are not issued to all parking violators.

Conventional parking meters have employed mechanisms for retaining a token or card (which may comprise a coin) being held in escrow and for collecting different rates for different time periods. U.S. Pat. No. 2,198,779 to Long, discloses a parking meter having legal and overtime time periods including a mechanism which receives a token to actuate the timer and setting the meter for the legal time period. If the parker returns prior to expiration of the legal time period, the meter is simply opened and the parker removes the card or token from a retaining mechanism. If the parker has not returned until expiration of the legal time period, the retaining mechanism causes the token to drop into a recepticle where it is retained. However, no provision is made for locking the card in the meter to prevent unauthorized removal of the card from the meter.

U.S. Pat. No. 2,199,330 to Bullock et al relates to a parking meter having variable rates. The meter is started by inserting a five cent coin which is then returned to initiate a free parking period. Upon expiration of the free parking period, additional coins must be added to stop the meter from running depending upon the amount of time which has expired. A tumbler arrangement is provided for resetting the meter by a government official. No coins are held within the meter in escrow for any significant portion of the parking period and then returned to the parker. This arrangement is disadvantageous since it requires constant monitoring and a parker may simply leave the area without paying to stop the running of the meter.

Other conventional parking meter mechanisms are disclosed in U.S. Pat. Nos. 3,828,907 to Bock, 2,171,345 to Rockola et al, 2,070,445 to Miller et al and 3,208,573 to Carroll et al. Conventional mechanisms for retaining coins in escrow to facilitate removal of the coins from devices other than coin operated meters are disclosed in U.S. Pat. Nos. 2,777,555 to Banning, 3,805,936 to Jensen and 3,828,903 to Levasseur.

These conventional devices suffer from numerous deficiencies. For example, since the meter of the Long patent does not have a mechanism to prevent unauthorized removal of the card or token held in escrow in the meter, someone may merely remove the escrow card or token from the meter, thereby disrupting the entire parking system. The parking meter of the Bullock et al patent requires constant monitoring of the parking space to ensure that a parker stops the meter from running by paying the appropriate fees prior to leaving the space. The other parking meters are disadvantageous since they do not satisfy the need of collecting higher parking fees automatically for overtime parking to discourage overtime parking, without constant monitoring or the high administrative cost resulting from the issuance of parking tickets.

SUMMARY OF THE INVENTION

Accordingly, it is an object of the present invention to provide a coin operated meter which better satisfies the needs of the local authorities and of the parking public. In particular, it is an object of the present invention to provide a coin operated meter in which coins are inserted in the meter to initiate its operation, are held securely in escrow therein during a predetermined operational period of the meter, are returned upon actuation of a retrieval mechanism prior to expiration of the predetermined time period, and are automatically captured after expiration of the predetermined time period.

Another object of the present invention is to provide a coin operated meter capable of holding coins in escrow which has a locking mechanism to prevent unauthorized release of the escrow coins.

A further object of the present invention is to provide a coin operated meter which collects fees at variable rates for different time periods.

A still further object of the present invention is to provide a coin operated meter of rugged construction which is inexpensive and simple to manufacture, maintain and operate.

The foregoing objects are attained by providing a meter comprising a housing having a coin box, a coin return and a clock mechanism within the housing. A mechanism is provided for winding the clock mechanism upon successive insertion of coins. Escrow support means selectively retain releasably at least one escrow coin in the housing, direct the escrow coin to the coin box and direct the escrow coin to the coin return. A program means is coupled to the escrow support means and to the clock mechanism and actuates the escrow support means in response to movement of the clock mechanism to direct the escrow coin to the coin box. Escrow release means are coupled to escrow support means to actuate the escrow support means directing the escrow coin to the coin return. To prevent unauthorized release of the coin from the escrow support means, lock means are coupled to the escrow release means.

By forming the meter of the present invention in this manner, coins for payment of the higher rate, overtime period are held in escrow during the normal or prepaid period. The lock means prevents unauthorized removal of the escrow coins during the prepaid period. If the parker returns prior to expiration of the prepaid period, the escrow release means permits the escrow coins to be retrieved. If the parker does not return until after expiration of the prepaid period, the programming of the meter actuates the escrow support means causing the escrow coin to fall into the coin box in payment of the overtime parking period.

In this manner, fees for overtime parking are collected automatically, thereby eliminating administrative costs involved in the issuance of parking tickets and the requirement for constant monitoring of the parking meter operation. This escrow arrangement is combined with the normal prepaid parking meter mechanism such that the meter both operates in the conventional prepaid parking time mode only after the insertion of escrow coins have initiated operation of the prepaid parking time mode.

Additionally, the specific meter construction in the present invention, described hereinafter, of a combination lock which can be set at a plurality of different combinations, of adjacent coin box and coin return passageways having an opening to permit the escrow coin to pass therebetween, of release and cross-over gates, of escrow gate means, of a plurality of separate escrow support means, and of the specific program mechanism, aid in the attainment of the objects of the invention noted above.

Other objects, advantages and salient features of the present invention will become apparent from the following detailed description, which taken in conjunction with the annexed drawings, discloses a preferred embodiment of the present invention.

BRIEF DESCRIPTION OF THE DRAWINGS

Referring to the drawings which form a part of this original disclosure.

DETAILED DESCRIPTION OF THE PREFERRED EMBODIMENT OF THE INVENTION

Figure 1:
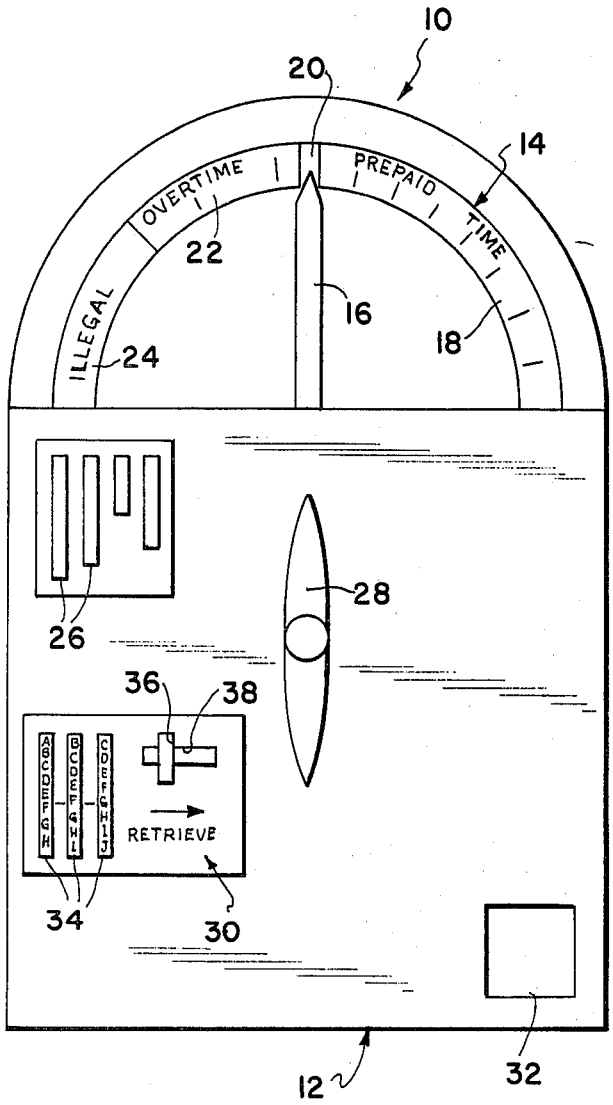
FIG. 1 is a front elevational view illustrating a meter in accordance with the present invention.

Referring initially to FIG. 1, a meter 10, in accordance with the present invention, has a housing 12 which may be suitably mounted upon a support, such as a metal pillar. The upper portion of housing 12 includes a window to permit viewing of dial 14 and pointer 16 to indicate the operational stage of meter 10. Dial 14 is divided into a plurality of arcuate sections defining a prepaid or normal time period 18, a grace period 20, an overtime period 22 and an illegal time period 24. Indicia is marked within some of the time periods to indicate actual time.

The lower portion of the front face of housing 12 includes coin insertion slots 26, a manually operated handle 28, a combination lock 30 and a coin return opening 32. Combination lock 30 has three tumbler or thumb wheels 34, each having a plurality of letters, numbers or other indicia imprinted on their periphery, and an actuator knob 36 movably mounted in a slot 38. The combination lock is of conventional design and is of the type which may be variously set at different combinations, e.g., of the type conventionally used in luggage. Movement of knob 36 is controlled by the lock such that it may only be moved to the right when the lock is set at the appropriate combination.

Figure 2:
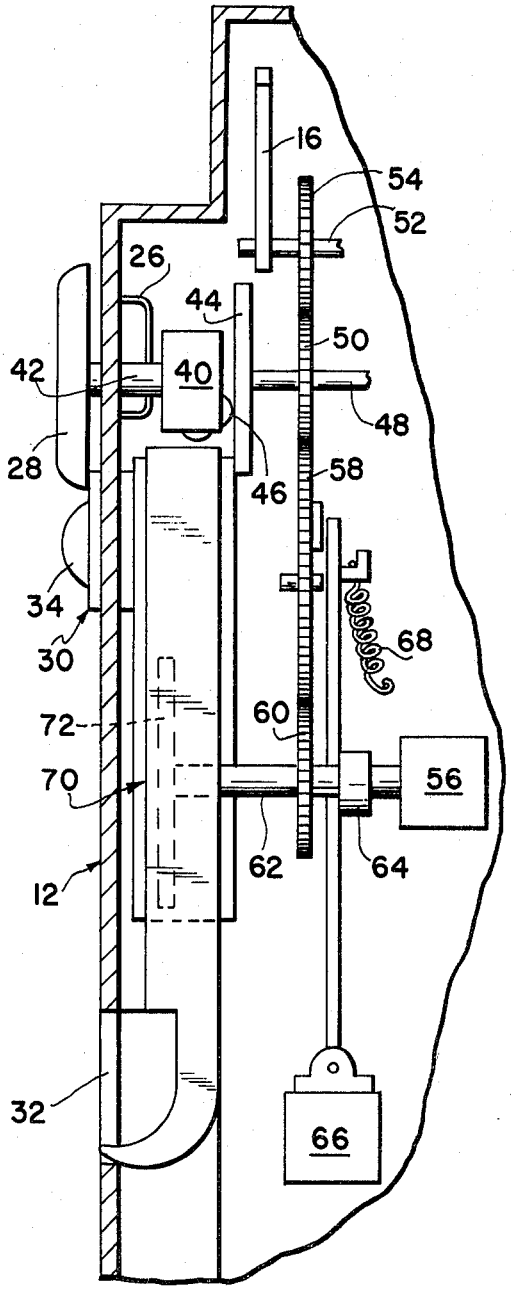
FIG. 2 is a partial, side elevational view in cross-section schematically illustrating details of the meter of FIG. 1.

In FIG. 2, the general arrangement of meter 10 is schematically illustrated. A coin carrier 40 is positioned in housing 12 for receiving coins inserted through slots 26, and is fixed to handle 28 by shaft 42. Shaft 42 extends through housing 12 to permit simultaneous rotation of handle 28 and coin carrier 40. A winding ring 44 is mounted in housing 12 for rotational movement about an axis coaxial with shaft 42. Slots 26, handle 28, coin carrier 40, shaft 42 and winding ring 44 are of conventional design. In conventional arrangements, a coin 46 in carrier 40 couples carrier 40 to winding wheel 44 such that rotational movement of carrier 40 results in a corresponding rotational movement of winding ring 44. The interconnection between coin 46 and winding ring 44 is such that the denomination of the coin affects the degree of winding in order that the higher value coins cause a greater degree of movement of the winding wheel. Since the specific mechanism for rotating the winding ring upon successive insertion of coins is conventional, a detailed discussion of this arrangement is not presented.

Winding ring 44 is fixed rotationally through shaft 48 to a gear 50. Pointer 16 is coupled to gear 50 through shaft 52 and gear 54 such that rotational movement of winding ring 44 causes a corresponding rotational movement of pointer 16. A clock mechanism 56 is coupled to gear 50 through gears 58, 60 and shaft 62. This coupling of winding ring 44 to clock mechanism 56 enables the clock mechanism to be wound upon successive insertion of coins. A clutch mechanism 64 permits clock mechanism 56 to be disengaged from shaft 62 to permit rapid resetting of the meter and to prevent damage to the clock mechanism by overwinding. A dash pot 66 is journaled to gear 58 and is biased by a spring 68, coupled at its opposite ends to the dash pot and to housing 12, to facilitate resetting of the meter.

Shaft 62 also couples clock mechanism 56 to programming mechanism 70 which is graphically illustrated as a blank box in FIG. 2. The details of the programming mechanism and its connection to lock 30 will be discussed fully hereinafter in connection with FIGS. 3–7.

Figure 3:
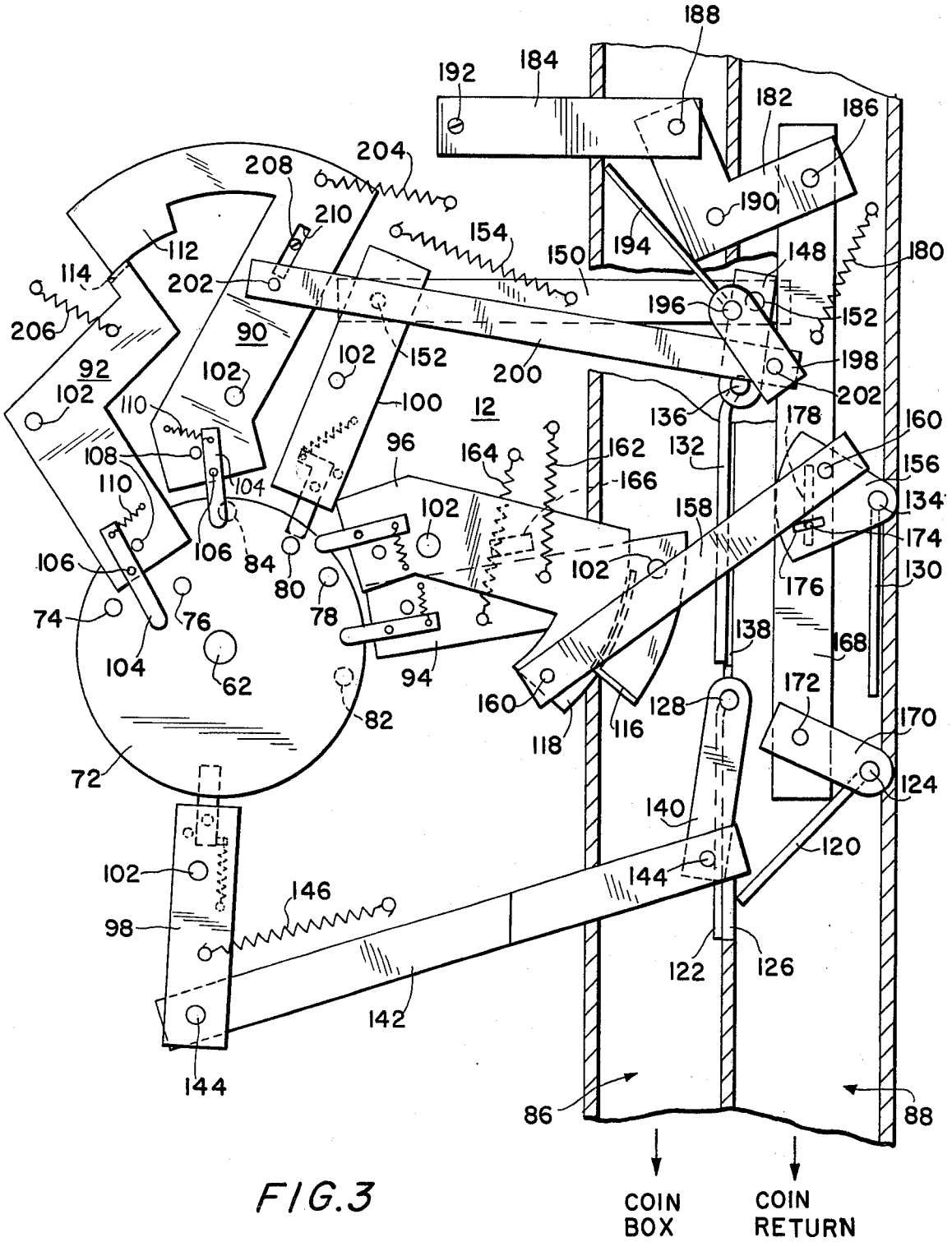
FIGS. 3–7 are partial, schematic views of the meter of FIG. 1 at various stages during its operation.

As illustrated in FIGS. 2 and 3, the program assembly includes a load wheel 72 which is fixed rotationally on shaft 62. The load wheel comprises a flat, circular disc having a plurality of actuating projections 74, 76, 78, 80, 82, 84 extending from its lateral faces. In housing 12, two adjacent channels are located adjacent load wheel 72 forming a coin box passageway 86 and a coin return passageway 88. Passageway 86 communicates with a coin box located in the bottom of meter 10, while passageway 88 communicates with coin return opening 32.

A plurality of levers or lever members 90, 92, 94, 96, 98, 100 are pivotally mounted on pivot pins 102. Pivot pins 102 are fixed in a suitable manner to housing 12. The levers are arranged so as to be generally radial with respect to shaft 62.

A spring biased detent is mounted on each lever adjacent the end thereof closest to shaft 62. Each detent comprises a pawl 104 pivotally coupled to its respective lever by a pin 106 approximately centrally located along the length of pawl 104. A fixed stop 108 extends from the lever adjacent pawl 104. A spring 110, coupled at its opposite ends to pawl 104 and the lever, biases the pawl against the stop.

Pawls 104 provide the coupling between the actuating projections on load wheel 72 and the levers such that upon rotation of load wheel 72 the individual levers will be pivotally moved in response to engagement with a respective actuating projection depending on the direction of rotation of load wheel 72. The levers, pawls and projections are sized and located in a suitable manner such that a single actuating projection contacts the pawl of a single lever. Specifically, projections 74, 76, 78, 80, 82, 84 are oriented to actuate levers 90, 92, 94, 96, 98, 100, respectively.

The pawls will only cause its respective lever to pivot in response to contact with one of the actuating projections when the load wheel is rotating in one direction, but will not cause such pivoting when the load wheel is moving in the opposite direction. For example, lever 90 is pivoted when its pawl 104 is contacted by actuating projection 74 when load wheel 72 is rotating in a clockwise direction as illustrated in FIG. 3. This pivoting results from stop 108 preventing pivoting of pawl 104 relative to lever 90. However, when load wheel 72 is rotating in a counter-clockwise direction, projection 74 will cause pawl 104 to pivot about pin 106 against the bias of spring 110 such that lever 90 does not pivot in response to the contact of projection 74 with its pawl 104. Each of the other levers pivots in response to contact with its respective projection in a similar manner such that lever 94 pivots only during clockwise rotation and levers 92, 96, 98, 100 pivot only during counter-clockwise rotation of load wheel 72.

Lever 90 is generally L-shaped having one leg extending radially relative to shaft 62 and its other leg extending laterally towards lever 92. The lateral leg has a radially inwardly extending catch 112. Lever 92 is also generally L-shaped with a radial leg and a lateral leg. The lateral leg of lever 92 has a latch 114 which extends radially outwardly and into the plane of the paper of FIG. 3 and which is adapted to engage catch 112. Catch 112 and latch 114 permit levers 90, 92 to engage one another as illustrated in FIGS. 4–7. Lever 90 pivots in a clockwise direction, as illustrated in FIG. 3 when lever 92 is pivoted in a clockwise direction to cause disengagement of the latch 114 from catch 112. Levers 90, 92 engage when lever 90 is pivoted counter-clockwise.

Levers 94 and 96 are arranged in a similar manner to permit them to be latched together. Lever 94 is generally L-shaped having a catch 116 extending out of the plane of the paper of FIG. 3 on its lateral leg. Lever 96 is L-shaped with a latch 118 extending radially outwardly from its lateral leg. Levers 94, 96 are engaged, as illustrated in FIG. 3, when lever 96 is pivoted clockwise, and are disengaged when lever 94 is pivoted counter-clockwise. Levers 98, 102 only have radially extending legs.

The first set of coins inserted in meter 10 are releasably retained in coin retain passageway 88, directed to the coin box through coin box passageway 86 and returned to the parker through coin return passageway 88 and coin return opening 32, selectively, by a plurality of escrow support mechanisms comprising gates pivotally mounted within passageways 86, 88. In the embodiment illustrated, two escrow support mechanisms for controlling movement of the escrow coins are provided, with each support mechanism being separately actuated. However, any suitable number of support mechanisms may be provided. Additionally, the system of the present invention may be arranged such that one or more escrow coins may be controlled by each support mechanism.

The lower escrow support mechanism comprises a lower release gate 120 and a lower cross-over gate 122. Lower release gate 120 is pivotally mounted in coin return passageway 88 by a pin 124 fixed thereto for simultaneous rotation therewith. Gate 120 is movable between a closed first position (illustrated in FIGS. 3, 4, 6 and 7) across passageway 88 to block passage of an escrow coin therethrough and an open second position (illustrated in FIG. 5) along passageway 88 permitting passage of an escrow coin therethrough to coin return opening 32. Lower cross-over gate 122 is pivotally mounted in passageway 86 adjacent to a lower opening 126 between passageways 86, 88 by a pin 128 fixed thereto. Cross-over gate 122 moves between a closed first position (illustrated in FIGS. 3–5 and 7) across opening 126 blocking passage of an escrow coin through the opening such that the escrow coin may be held between gates 120, 122, and an open second position (illustrated in FIG. 6) spaced from opening 126 permitting passage of an escrow coin through opening 126 into coin box passageway 86 and subsequently into the coin box in meter 10.

The upper escrow support mechanism comprises an upper release gate 130 and an upper cross-over gate 132. Release gate 130 is pivotally mounted in passageway 88 by a pin 134 fixed thereto between a closed first position (illustrated in FIGS. 4, 6 and 7) and an open second position (illustrated in FIGS. 3 and 5). Cross-over gate 132 is pivotally mounted in passageway 86 by pin 136 fixed thereto adjacent upper opening 138 between passageways 86, 88 between a closed first position (illustrated in FIGS. 3–6) and an open second position (illustrated in FIG. 7).

Lower cross-over gate 122 is actuated by lever 98 and is coupled thereto by links 140, 142. Link 140 is fixed at one end to pin 128. Link 142 is pivotally coupled at its opposite ends to the other end of link 140 and to lever 98 by pins 144. Spring 146, coupled at its opposite ends to lever 98 and to housing 112, biases lower cross-over gate 122 towards its closed first position.

Upper cross-over gate 132 is actuated by and coupled to lever 100 by links 148, 150. Link 148 is fixed to pin 136 for simultaneous rotation therewith. Link 150 is pivotally coupled at its opposite ends to link 148 and lever 100 by pins 152. A spring 154, coupled at its opposite ends to housing 12 and link 150, biases upper cross-over gate 132 towards its closed position.

Upper release gate 130 is coupled to lever 96 by links 156, 158. Link 156 is fixed to pin 134 for simultaneous rotation therewith. Link 158 is pivotally coupled at its opposite ends to link 156 and lever 96 by pins 160. Spring 162, coupled at its opposite ends to lever 96 and housing 12, biases lever 96 counter-clockwise and thereby biases upper release gate 130 towards its closed, first position.

Lever 94 is spring biased to pivot clockwise by spring 164 coupled at its opposite ends to lever 94 and housing 12. Thus, spring 164 biases lever 94 towards the engagement of catch 116 and latch 118. A stop 166 is fixed to housing 12 adjacent lever 94. Spring 164 biases lever 94 in a clockwise direction against stop 164.

Release gates 120, 130 are each coupled to a release link 168. Lower release gate 120 is coupled to release link 168 through link 170 which is fixed to pin 124 for simultaneous rotation therewith and pivotally coupled to link 168 by pin 172. Link 158 is coupled to link 168 by a floting pin 174 which is slidably received in a slot 176 in link 156 and in a slot 178 in release link 168. Slot 176 extends radially relative to pin 134. Slot 178 is elongated in the axial direction of release link 168. This coupling of links 156, 168 by floting pin 174 in slots 176, 178 permits separate operation of upper release gate 130 by lever 96 as well as by release link 168. A spring 180, coupled at its opposite ends to housing 12 and to release link 168, biases release link 180 upwardly, and thereby biases lower release gate 120 towards its closed first position.

Figure 5:
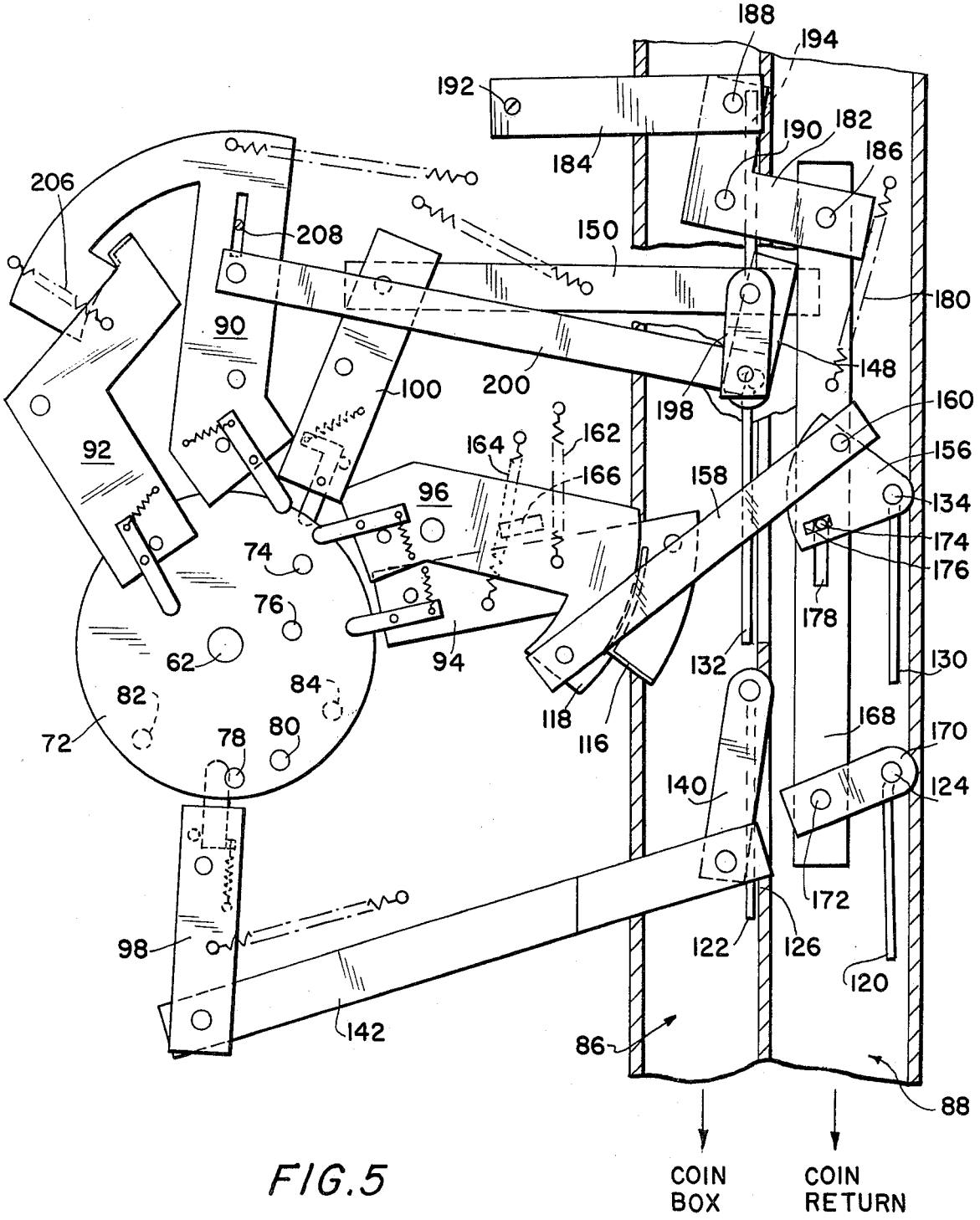

Release link 168 is coupled to knob 36 of combination lock 30 by links 182, 184. Link 182 is pivotally coupled at its opposite ends to the top of release link 168 by pin 186 and to one end of link 184 by pin 188, and is pivotally coupled therebetween to housing 12 by pivot pin 190. The opposite end of link 184 is pivotally coupled to a shaft 192 fixed to and extending from knob 36. In this manner, both release gates may be opened, as illustrated in FIG. 5, by moving links 182, 184 such that release link 168 moves downwardly causing links 156, 170 to pivot counter-clockwise. Thus, actuation of release link 168 will cause any escrow coins supported by gates 120, 130 to fall through passageway 88 to the coin return opening 32 for retrieval by the parker.

An escrow gate 194 is pivotally mounted in coin box return passageway 86 above upper opening 138 by pivot pin 196 fixed thereto. Escrow gate 194 is actuated by and coupled to lever 90 by links 198, 200. Link 198 is fixed to pivot pin 196 at one of its ends. Link 200 is pivotally coupled at its opposite ends to the other end of link 198 and to lever 90 by pins 202. When lever 90 pivots clockwise, escrow gate 194 is closed (as illustrated in FIG. 3) blocking passage of coins into coin box passageway 86. When lever 90 pivots counter-clockwise, escrow gate 94 is moved to its open position illustrated in FIGS. 4–7. Spring 204 biases lever 90 to pivot clockwise, thereby biasing escrow gate 194 towards its closed position. Spring 204 is fixed at its opposite ends to housing 12 and to lever 90. Escrow gate 194 prevents the purchase of prepaid time prior to placing the full amount of money in escrow within meter 10. Spring 206, fixed at its opposite end to housing 12 and lever 92, biases lever 92 to pivot counter-clockwise.

Lever 90 is coupled to combination lock 30 by a shaft 208 extending from the lock and slidably received in slot 210. Shaft 208 controls the mechanism in lock 30 for locking in the code set by the parker. When lever 90 pivots counter-clockwise, the code is locked in and when lever 90 pivots clockwise, the code may be set in.

In operation, the escrow support mechanism and the program mechanism are initially positioned, before insertion of the first coin, in the orientation illustrated in FIG. 3. In this orientation, escrow gate 194 is in its closed position blocking passage of coins into coin box passageway 86, upper release gate 130 is in its open position, and gates 120, 122, 132 are in their closed positions. Additionally, levers 90, 92 are unlatched, while levers 94, 96 are latched together. Prior to insertion of the first coin, a parker's individual code may be set in with tumbler wheels 34.

At this time, the first escrow coin (typically a $1 coin piece) is inserted through the appropriate coin slot 26. The coin is received in coin carrier 40 and is rotated therewith upon rotation of handle 28 to advance winding ring 44 through an arc of approximately 30°. Movement of winding ring 44 also advances pointer 16, winds clock mechanism 56 and rotates load wheel 72 clockwise as seen in FIG. 3. This first escrow coin will be dumped in and come to rest in coin return passageway 88 in contact with lower gates 120, 122.

Figure 4:
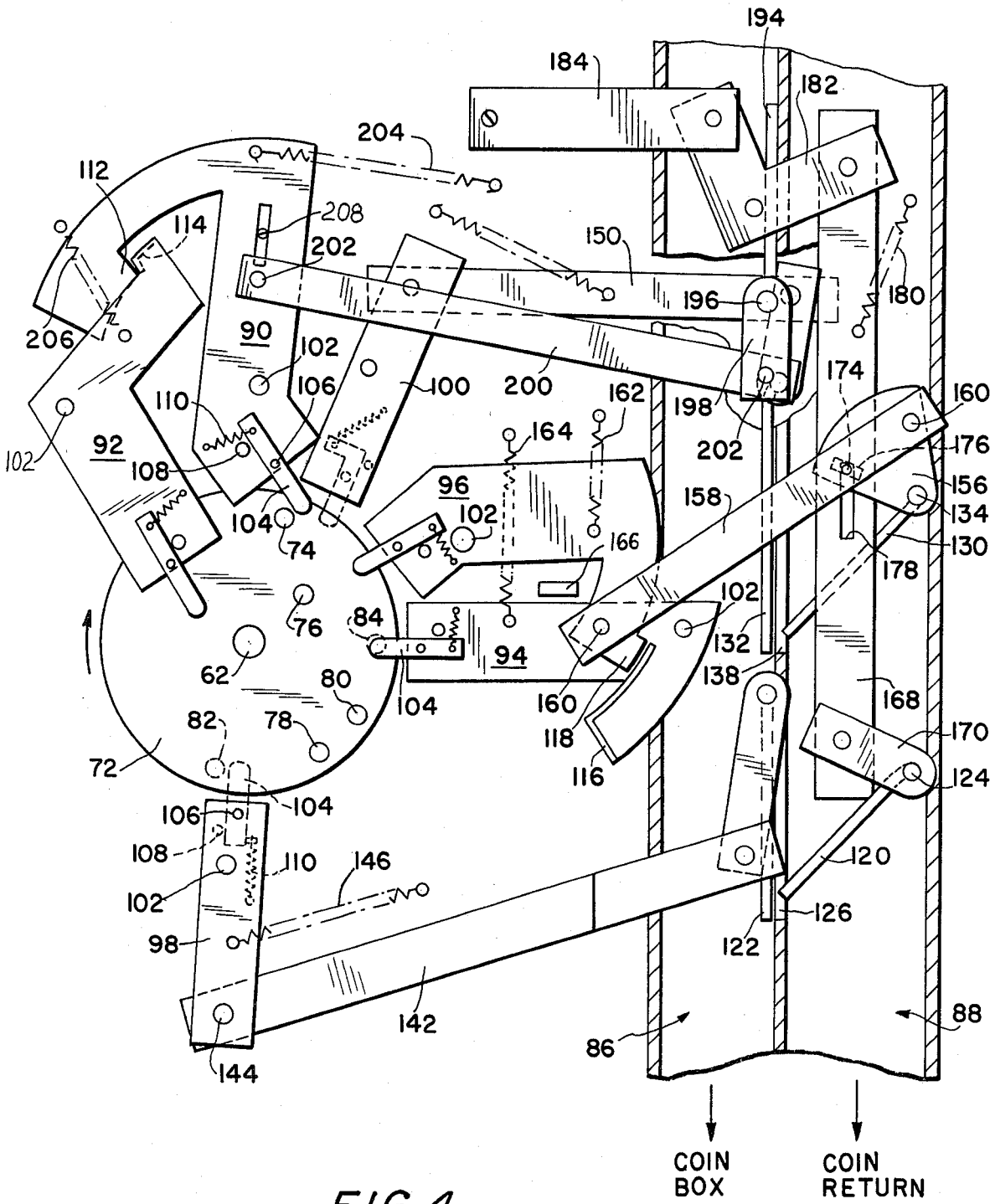

After the first escrow coin is fully seated on gates 120, 122, the second escrow coin is inserted in coin slot 26 and handle 128 is again rotated to further advance winding ring 44, pointer 16, clock mechanism 56 and load wheel 72. As the second escrow coin is being advances in coin carrier 40, projection 78 contacts pawl 104 of lever 94 causing lever 94 to pivot counter-clockwise against the bias of spring 164 and causing catch 116 to disengage from latch 118 of lever 96. This disengagement causes lever 96 to pivot counter-clockwise under bias of spring 162 about its pivot 102, thereby causing upward movement of link 158, clockwise pivoting of link 156, pin 134 and upper release gate 130 to move upper release gate 130 to its closed position as illustrated in FIG. 4. Slots 176, 178 in links 156, 168, respectively, permit movement of the link 156 and floating pin 174 without being inhibited by release link 168. With upper release gate 130 in its closed position, the second escrow coin is releasably held within coin return passageway 88 in escrow by upper gates 130, 132.

The addition and rotation of a third escrow coin further advances load wheel 72 to the position illustrated in FIG. 4 such that projection 74 contacts pawl 104 of lever 90 causing lever 90 to pivot counter-clockwise. Counter-clockwise rotation of lever 90 causes latch 114 to cam on the lower camming surface of catch 112 such that lever 92 pivots clockwise against the bias of spring 206. This pivoting of lever 92 and of lever 90 causes catch 112 to engage latch 114 to retain levers 90, 92 in the position illustrated in FIG. 4. This counter-clockwise pivoting of lever 90 also causes movement of link 200 resulting in clockwise pivoting of link 198, pin 196 and escrow gate 194 to move escrow gate 194 to its open position illustrated in FIG. 4 to permit passage of coins into coin box passageway 86 and locks in the code set in tumbler wheels 34. At this time, pointer 16 is in grace period 20 (illustrated in FIG. 1) and additional coins can be added in the conventional manner to advance pointer 16 into the prepaid time zone 14 to the extent desired by the parker. Spring 206 keeps levers 90, 92 engaged to maintain escrow gate 194 in its open position.

Once the desired amount of prepaid time has been purchased by the parker, clock mechanism 56 starts winding down the mechanism causing load wheel 72 and pointer 16 to rotate counter-clockwise. If the parker returns prior to pointer 16 passing through grace period 20, additional prepaid time may be purchased by insertion of additional coins and rotation of handle 28. All coins used for purchasing the prepaid time pass freely through passageway 86 directly into the coin box after actuating winding ring 44.

The counter-clockwise rotation of lever 90 also locks in the code or combination set by the parker with the tumbler wheels 34. This permits tumbler wheels to now be scrambled such that knob 36 and shaft 192 are locked in the position illustrated in FIG. 3.

If the parker returns prior to pointer 16 passing through grace period 20, the three escrow coins may be retrieved by operating the escrow release mechanism as illustrated in FIG. 5. When the parker returns to the meter, the individual code or combination previously locked in by the parker is reset in the combination lock by movement of tumbler wheels 34. This will unlock the combination lock permitting movement of knob 36 and therefore of shaft 192. Movement of shaft 192 is prevented by lock 30 unless the individual code is reset. Movement of shaft 192 from the position illustrated in FIGS. 3 and 4 to the position illustrated in FIG. 5 causes clockwise pivoting of link 182 about its pivot 190 and downward movement of release link 168. Downward movement of release link 168 causes counter-clockwise pivoting of link 156, pin 134 and gate 130 through floating pin 174 and causes counter-clockwise pivoting of link 170, pin 124, and gate 120 through pin 172 such that release gates 120, 130 are moved to their opened positions as illustrated in FIG. 5. The opening of release gates 120, 130 permits all of the escrow coins held thereby to freely pass through coin return passageway 88 to coin return opening 32 permitting retrieval thereof by the parker. Once the escrow coins have been returned, spring 180 causes release link 168 to move upwardly to return gates 120, 130 and links 170, 156, 182, 184 to their initial position (illustrated in FIG. 3).

Movement of the link 184 also activates clutch 64 in shaft 62 to disengage clock mechanism 56 from shaft 62 permitting rapid wind down of the clock mechanism and resetting of pointer 16, winding ring 44 and load wheel 72 under the action of spring 68 coupled to gear 58. The movement of these mechanisms under the bias of spring 68 is dampened by dash pot 66 to prevent damage to these mechanisms.

During the rapid wind down and counter-clockwise rotation of load wheel 72, projection 80 engages pawl 104 of lever 96 causing engagement of catch 116 and latch 118 such that upper release gate 130 will remain open, ready for insertion of the first escrow coin, as illustrated in FIG. 3. Also projection 76 will cause lever 92 to pivot clockwise causing lever 90 to pivot clockwise to close escrow gate 194 and permit setting in of an individual combination in combination lock 30.

Figure 6:
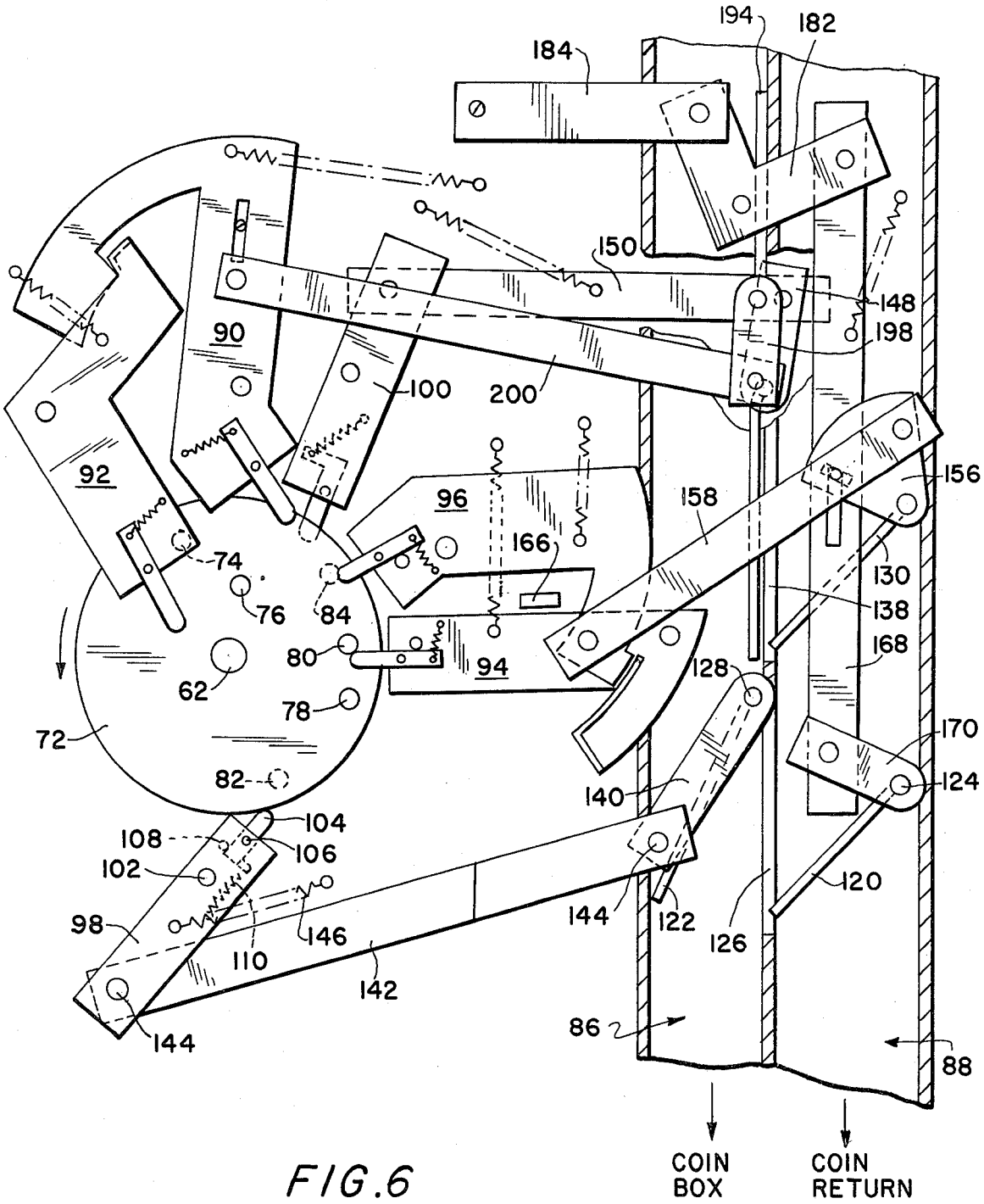

If the parker does not return until after pointer 16 has passed through grace period 20, the first escrow coin retained by gates 120, 122 is captured by the operation illustrated in FIG. 6. As the pointer passes into overtime zone 22, projection 82 engages pawl 104 of lever 98 causing lever 98 to pivot clockwise against the bias of spring 146. Clockwise pivoting of lever 98 moves link 142 and rotates link 140, pivot pin 128 and lower cross-over gate 122 clockwise moving gate 122 to its open second position. This movement of gate 122 opens lower opening 126 causing the first escrow coin to fall by gravity through opening 126 and coin box passageway 86 into the coin box. The slanted closed position of gate 120 facilitates movement of the first escrow coin through opening 126 and into passageway 86. The opening of cross-over gate 122 is momentary since it is closed under the bias of spring 146 once the first escrow coin has fallen through opening 126 such that lever 98, links 142, 140 and gate 122 are returned to their initial closed position illustrated in FIG. 3.

Figure 7:
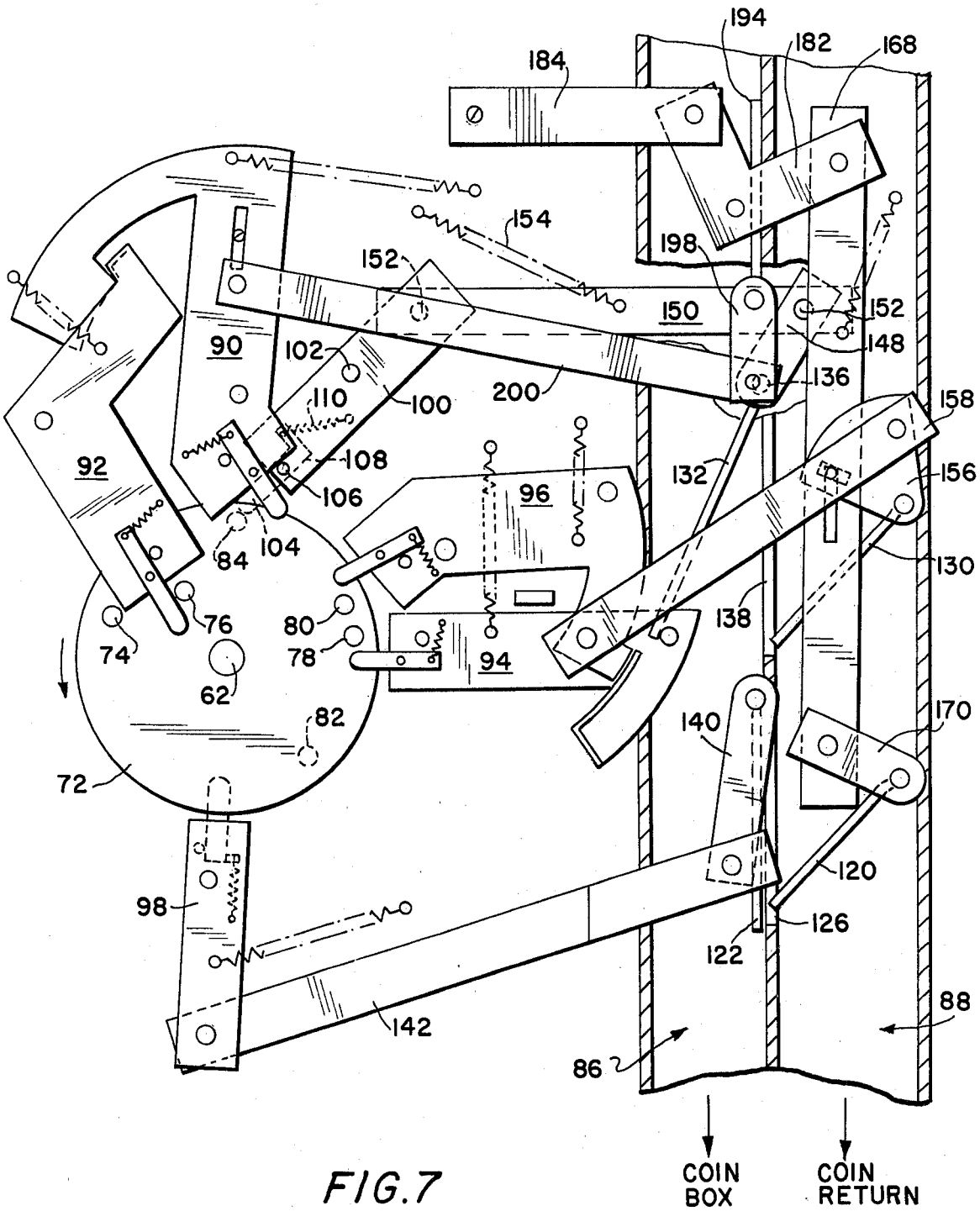

If the parker still has not returned after a predetermined time, the other two escrow coins held by gates 130, 132 are captured by the operation of the mechanism illustrated in FIG. 7. At this time, projection 84 engages pawl 104 of lever 100 causing lever 100 to pivot clockwise causing movement of link 150 and clockwise pivoting of link 148, pivot pin 136 and upper cross-over gate 132. As upper cross-over gate 132 opens upper opening 138, the other two escrow coins then fall by gravity through opening 138, into coin box passageway 86 and ultimately into the coin box. Spring 154 returns lever 100, links 150, 148 and gate 132 to their normally closed position once projection 184 has completely passed by pawl 104 of lever 100.

If the parker still does not return after an additional predetermined period, pointer 116 will pass into the illegal zone indicating illegal parking for which a parking violation should issue.

If the parker returns after the capture of the first escrow coin, but before capture of the other two escrow coins, the escrow release mechanism can be actuated as discussed above and illustrated in FIG. 5 permitting retrieval of the other escrow coins.

During the wind down into the illegal period after capture of the two upper escrow coins, projection 80 engages pawl 104 of lever 96 causing it to pivot clockwise and causing engagement of catch 116 and latch 118 to move and lock upper release gate 130 to its open starting position as illustrated in FIG. 3. Additionally, projection 76 will engage pawl 104 of lever 92 causing lever 92 to pivot clockwise releasing the engagement of catch 112 and latch 14 such that lever 90 pivots clockwise closing escrow gate 194. This will reset the mechanisms for the starting position illustrated in FIG. 3. The meter is then ready for the next parker.

By forming meter 10 in this manner, prepaid parking time may be purchased in a conventional manner after the money for overtime parking is held in escrow within the meter. Upon expiration of the prepaid time, the escrow money is automatically captured by the meter such that the meter need not be monitored to insure payment of the higher parking fee rates for the overtime parking.

Thus, the parking meter of the present invention will discourage overtime parking by the relatively high fee rate required therefor while still permitting use of this time period without the inconvenience of monitoring by the local authorities or of the inconvenience to both the public and the local authorities by issuance of a parking ticket.

While only a single load wheel 72 is disclosed, a plurality of load wheels may be fixed in series on shaft 62 in a number necessary to facilitate arrangement of the levers and links necessary for operating the various gates within the system.

While a particular embodiment has been chosen to illustrate the invention, it will be understood by those skilled in the art that various changes and modifications can be made therein without departing from the scope of the invention as defined in the appended claims.

What is claimed is:

1. A meter, comprising:

a housing having a coin box and a coin return;

a clock mechanism located in said housing;

means for winding said clock mechanism upon successive insertion of coins;

escrow support means for releasably retaining at least one escrow coin in said housing, for directing the escrow coin to said coin box and for directing the escrow coin to said coin return, selectively;

program means, coupling said escrow support means to said clock mechanism, for actuating said escrow support means in response to movement of said clock mechanism to direct the escrow coin to said coin box;

escrow release means, coupled to said escrow support means, for activating said escrow support means to directing the escrow coin to said coin return; and escrow lock means, coupled to said escrow release means, for preventing unauthorized release of the coin in said escrow support means.

2. A meter according to claim 1, wherein said escrow lock means comprises a combination lock.

3. A meter according to claim 2, wherein said combination lock can be set at a plurality of different combination settings and includes means coupled to said program means for locking in a particular combination.

4. A meter according to claim 1, wherein said housing has adjacent coin box and coin return passageways having at least one opening therebetween to permit the escrow coin to pass therebetween; and said escrow support means is located adjacent said opening.

5. A meter according to claim 4, wherein said escrow support means comprises:

a release gate pivotably mounted in one of said passageways for movement between a first position across said one passageway blocking passage of the escrow coin therethrough and, a second position along said one passageway permitting passage of the escrow coin therethrough; and a cross-over gate pivotally mounted adjacent said opening for movement between a first position across said opening blocking passage of the escrow coin through said opening from said one passageway to the other passageway, and a second position spaced from said opening permitting passage of the escrow coin through said opening from said one passageway to the other passageway.

6. A meter according to claim 5, wherein said release gate is mounted in said coin return passageway.

7. A meter according to claim 4, wherein escrow gate means is coupled to said program means and is mounted in said coin box passageway for movement between a first position across said coin box passageway blocking passage of coins therethrough prior to retention of a predetermined number of escrow coins by said escrow support means and a second position along said coin box passageway permitting passage of coins therethrough after retention of a predetermined number of escrow coins by said escrow support means.

8. A meter according to claim 1, wherein two separate escrow support means are provided in said housing for separately directing at least two escrow coins.

9. A meter according to claim 1, wherein said program means comprises:

a load wheel mounted for rotation in said housing and driven by said clock mechanism, said load wheel having a plurality of actuating projections thereon;

a plurality of lever members pivotally mounted in said housing for movement in response to engagement with respective actuating projections; and linkage means, coupling said lever members to said escrow support means, for actuating said escrow support means in response to movement of said lever members.

10. A meter according to claim 9, wherein each said lever member has a spring biased detent means, mounted thereon and extending adjacent said load wheel, for moving said lever member coupled thereto in response to contact with one of said actuating projections when said load wheel is rotating in one direction, but not moving said lever member coupled thereto in response to contact with said one of said actuating projections when said load wheel is rotating in an opposite direction.

11. A meter according to claim 10, wherein said detent means comprises a pawl pivoted to one of said lever members; a stop member fixed to said one lever member adjacent said pawl; and a spring attached to said pawl and said one lever member biasing said pawl against said stop member.

* * * * *